US009509066B2

(12) United States Patent
Sasano

(10) Patent No.: US 9,509,066 B2
(45) Date of Patent: Nov. 29, 2016

(54) CONNECTOR

(71) Applicant: OMRON Corporation, Kyoto-shi, Kyoto (JP)

(72) Inventor: Naoya Sasano, Tokyo (JP)

(73) Assignee: OMRON Corporation, Kyoto (JP)

( * ) Notice: Subject to any disclaimer, the term of this patent is extended or adjusted under 35 U.S.C. 154(b) by 8 days.

(21) Appl. No.: 14/557,007

(22) Filed: Dec. 1, 2014

(65) Prior Publication Data

US 2015/0214639 A1 Jul. 30, 2015

(30) Foreign Application Priority Data

Jan. 28, 2014 (JP) ..... 2014-013482

(51) Int. Cl.
*H01R 4/48* (2006.01)
*H01R 13/11* (2006.01)
*H01R 13/20* (2006.01)

(52) U.S. Cl.
CPC ..... *H01R 4/48* (2013.01); *H01R 13/113* (2013.01); *H01R 13/20* (2013.01)

(58) Field of Classification Search
CPC .... H01R 4/48; H01R 4/4809; H01R 13/113; H01R 13/20
USPC ..... 439/775, 786, 787
See application file for complete search history.

(56) References Cited

U.S. PATENT DOCUMENTS

| | | | |
|---|---|---|---|
| 4,159,158 | A | 6/1979 | Weidler |
| 4,564,259 | A | 1/1986 | Vandame |
| 4,679,887 | A | 7/1987 | Jackson |
| 2009/0253315 | A1 | 10/2009 | Busies et al. |

FOREIGN PATENT DOCUMENTS

| | | | |
|---|---|---|---|
| CN | 2219546 | Y | 2/1996 |
| CN | 202855982 | U | 4/2013 |
| EP | 0098650 | A1 | 1/1984 |
| EP | 0465291 | A1 | 1/1992 |
| EP | 0887885 | A2 | 12/1998 |
| EP | 1211756 | A1 | 6/2002 |
| FR | 2701338 | A1 | 8/1994 |
| JP | H11-111367 | A | 4/1999 |
| WO | 2011053276 | A1 | 5/2011 |

OTHER PUBLICATIONS

Extended European Search Report issued in corresponding European Application No. 14194949.5 dated Jun. 10, 2015 (8 pages).
First Office Action issued in corresponding Chinese Application No. 201410709621.7, mailed on Aug. 3, 2016 (16 pages).

*Primary Examiner* — Khiem Nguyen
(74) *Attorney, Agent, or Firm* — Osha Liang LLP

(57) ABSTRACT

A connector that can adjust a force for inserting a terminal includes a base and a spring. The spring has a bend portion bent from the edge of the base and an abutment portion continued from the bend portion. The spring extends along the base and is sandwiched between the base and the abutment portion. A terminal is inserted toward the bend portion from an opening located on an opposite side of the bend portion and formed between the base and the abutment portion.

8 Claims, 13 Drawing Sheets

CONNECTOR

BACKGROUND OF THE INVENTION

The present invention relates to a connector for use in the power source of, e.g., an air conditioner, a washing machine, and so on.

Japanese Patent Application Laid-Open (JP-A) No. 11-111367 describes a connector which inserts and sandwiches a terminal between an upper spring and a lower spring. In this connector, to sandwich the terminal between the upper spring and the lower spring, the force for sandwiching the terminal is required to be increased.

However, when the force for sandwiching the terminal is increased, the force for inserting the terminal between the upper spring and the lower spring is required to be large. Consequently, there is a fear of damaging the substrate mounted on the terminal when the terminal is inserted.

One or more embodiments of the present invention provide a connector that can reduce the force for inserting a terminal and is hard to cause the terminal to fall off.

SUMMARY OF THE INVENTION

A connector, in accordance with one or more embodiments of the present invention, includes: a base; and a spring which has a bend portion bent from the edge of the base, and an abutment portion continued from the bend portion and extending along the base, and sandwiches, between the base and the abutment portion, a terminal inserted toward the bend portion from an opening located on the opposite side of the bend portion and formed between the base and the abutment portion.

The spring includes the bend portion and the abutment portion, so that the length of the spring can be adjusted to adjust the force for sandwiching the terminal between the spring and the base. Thereby, the terminal can be easily inserted between the spring and the base.

In addition, when the terminal is inserted between the spring and the base from the opening, the end of the terminal is abutted onto the bend portion. Therefore, the terminal can be easily positioned.

According to one or more embodiments of the present invention, the connector further includes a cover extending from the base and covering the abutment portion with predetermined spacing from the outer face of the abutment portion, the cover having a top wall provided with an engagement portion which is position regulated by being engaged with the end of the abutment portion pushingly expanded when the terminal is inserted into and removed from the opening.

The engagement portion and the end of the abutment portion are engaged with each other, so that the shift amount of the spring can be regulated to prevent the spring from being damaged. It should be noted that the outer face of the abutment portion is referred to as the face of the abutment portion opposite to the base.

According to one or more embodiments of the present invention, the spring extends from one edge of the base in rectangular shape, and the cover extends from the other edge adjacent to the one edge, and is bent in the direction cross to the direction from the opening of the spring toward the bend portion to cover the spring.

The connector includes a double configuration in which the cover covers the spring. Therefore, other members can be prevented from interfering with the spring from outside, so that the spring can be protected.

According to one or more embodiments of the present invention, at least one of the base and the abutment portion is provided with a fall-off prevention projection which projects in the inward direction and is engaged into a through hole of the terminal for fall-off prevention.

The fall-off prevention projection is engaged into the through hole, so that the terminal sandwiched between the base and the abutment portion can be reliably prevented from falling off. It should be noted that the inward direction of the base is referred to as the direction toward the abutment portion opposite thereto, and that the inward direction of the abutment portion is referred to as the direction toward the base opposite thereto.

According to one or more embodiments of the present invention, the fall-off prevention projection has a water droplet shape including a triangular projection located on the opening side and having a triangular shape in plan view so that the width thereof is increased from the opening toward the bend portion, and a semi-circular projection located on the bend portion side, having a semi-circular shape in plan view, and integrally molded with the triangular projection.

With the above configuration, the terminal can be easily inserted between the base and the abutment portion, and the terminal is hard to fall off once the terminal is inserted between the base and the abutment portion.

According to one or more embodiments of the present invention, at least one slit for spring force adjustment is provided in the abutment portion.

By providing the slit, the spring force of the spring can be adjusted.

According to one or more embodiments of the present invention, the connector further includes a pressingly holding portion which pressingly holds a cable conducting with the terminal, wherein the direction from the opening toward the bend portion is orthogonal to the axial direction of the held cable.

According to this embodiment, for example, the general-purpose connector can be obtained.

According to one or more embodiments of the present invention, the connector further includes a pressingly holding portion which pressingly holds a cable conducting with the terminal, wherein the direction from the opening toward the bend portion is parallel to the axial direction of the held cable.

According to this embodiment, for example, the general-purpose connector can be obtained.

According to one or more embodiments of the present invention, the connector further includes a housing having an insertion hole communicating into the opening formed between the base and the abutment portion accommodated therein, and a pressing projection which projects in the inward direction from the edge of the insertion hole and can pushingly expand the end of the spring when the terminal is pulled.

According to this embodiment, for example, the pressing projection of the housing pushes up the end of the spring, so that when the housing is held to pull the connector, the end of the spring is pushingly expanded to easily pull the terminal from the connector. It should be noted that the inward direction is referred to as the direction toward the inside of the housing.

DETAILED DESCRIPTION OF THE INVENTION

Embodiments of the present invention will be discussed below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Example

Figure 1:
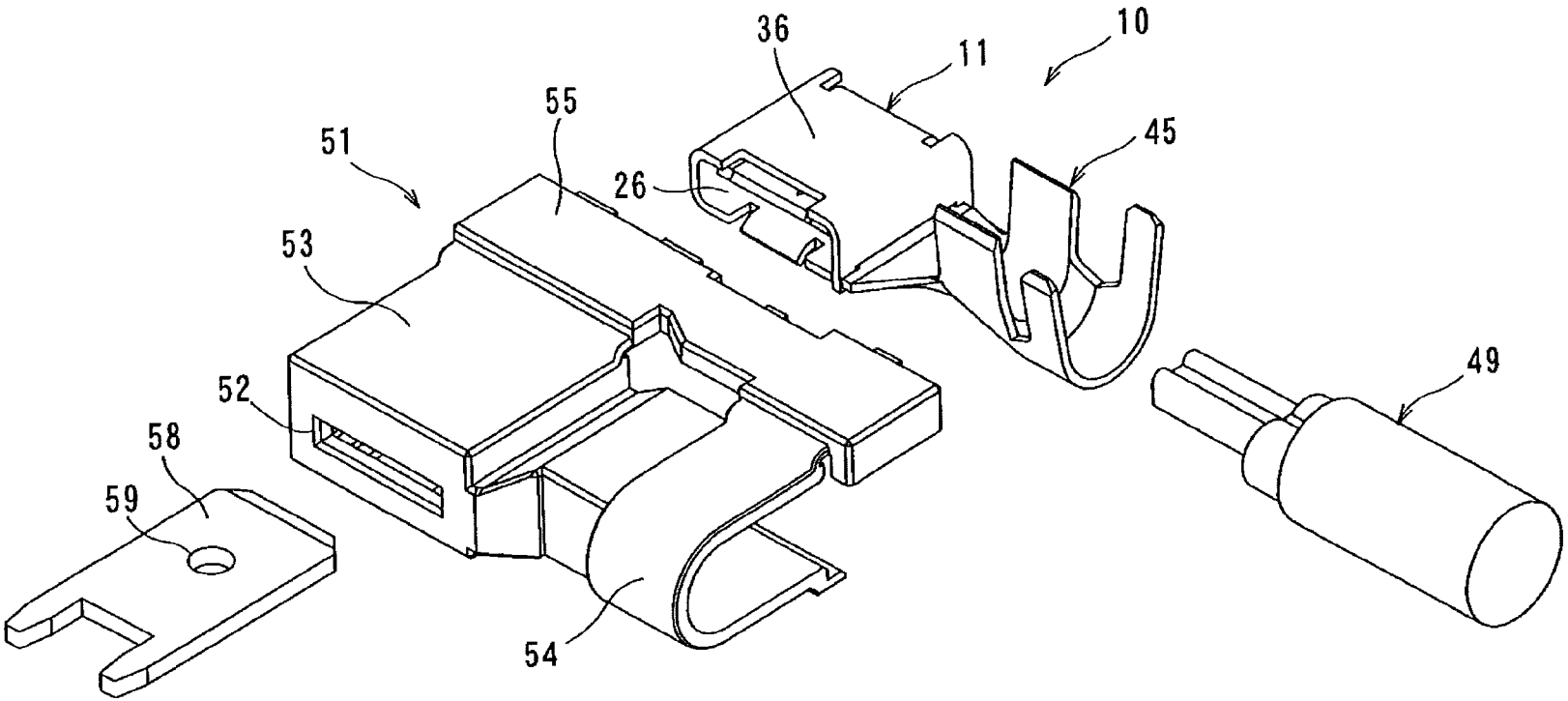
FIG. 1 is an exploded perspective view of a connection terminal using a connector according to one or more embodiments of the present invention.

As shown in FIG. 1, a connector 10 of a first example is made of metal, and includes a connector body 11 formed at one end, and a pressingly holding portion 45 formed at the other end. After the end of a cable 49 is pressingly fit onto the pressingly holding portion 45, the connector 10 is accommodated in a housing 51 having an insertion hole 52. A terminal 58 is inserted through the insertion hole 52 into an opening 26 of the connector body 11, thereby conducting the cable 49 with the terminal 58. In the terminal 58, a circular through hole 59 is formed.

Figure 5:
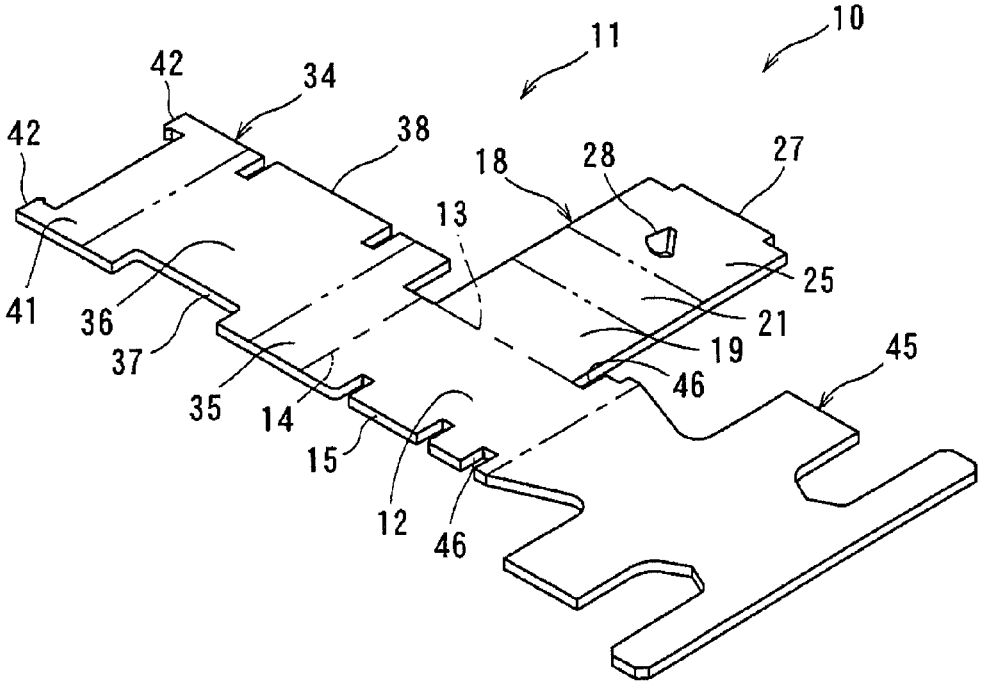
FIG. 5 is a developed view of a connector according to one or more embodiments of the present invention.

As shown in FIG. 5, the connector body 11 includes a rectangular base 12, a spring 18 extending from one edge 13 of the base 12, and a cover 34 extending from the other edge 14 adjacent to the one edge 13 of the base 12.

The base 12 is adjacent to the pressingly holding portion 45. In the boundary portion between the base 12 and the pressingly holding portion 45, cutaway portions 46 are formed. In assembled state, at the edge of the base 12 opposite to the end of the spring 18, a first tongue 15 is provided to be curved downward.

Figure 6:
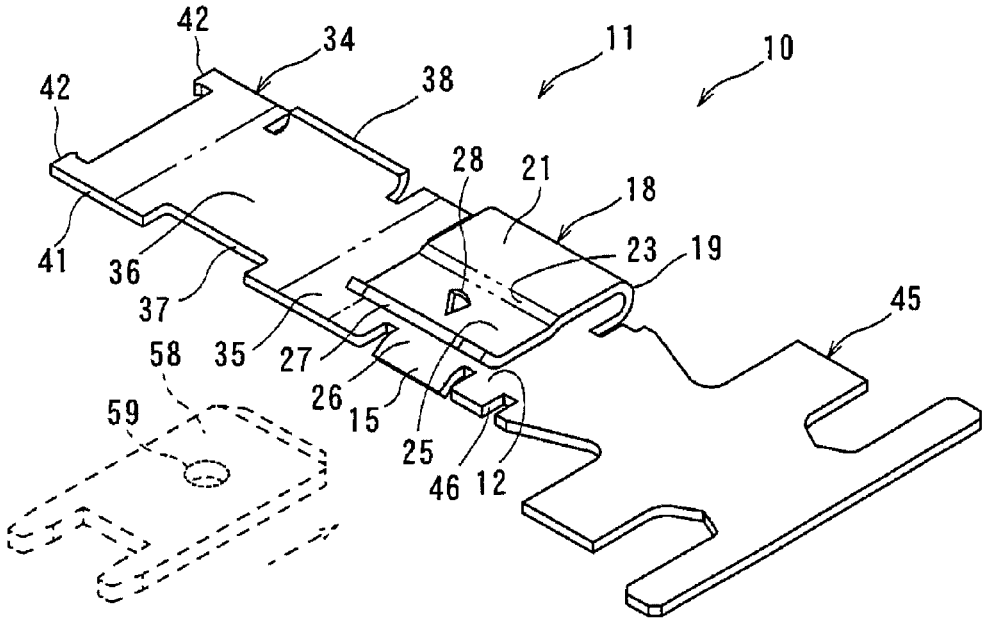
FIG. 6 is a perspective view showing a procedure of assembling a connector according to one or more embodiments of the present invention.

As shown in FIG. 6, the spring 18 has a bend portion 19 bent from the one edge 13 of the base 12, and an abutment portion 25 continued from the bend portion 19 through a plate-shaped portion 21 described below and extending along the base 12. Between the base 12 and the abutment portion 25, the opening 26 is formed to be located opposite to the bend portion 19. The spring 18 sandwiches, between the base 12 and the abutment portion 25, the terminal 58 inserted from the opening 26 toward the bend portion 19.

Hereinafter, the direction inserting the terminal 58 into the spring 18 is referred to as a back side, and the direction pulling the terminal 58 from the spring 18 is referred to as a front side.

The bend portion 19 is bent in U-shape. From the upper end of the bend portion 19 toward the front side thereof, the plate-shaped portion 21 extends in parallel with the base 12. The plate-shaped portion 21 is formed in rectangular shape having long sides in the direction orthogonal to the direction inserting the terminal 58. In addition, the space between the plate-shaped portion 21 and the base 12 is formed to be substantially equal to the thickness of the terminal 58 (see FIG. 14).

Figure 4:
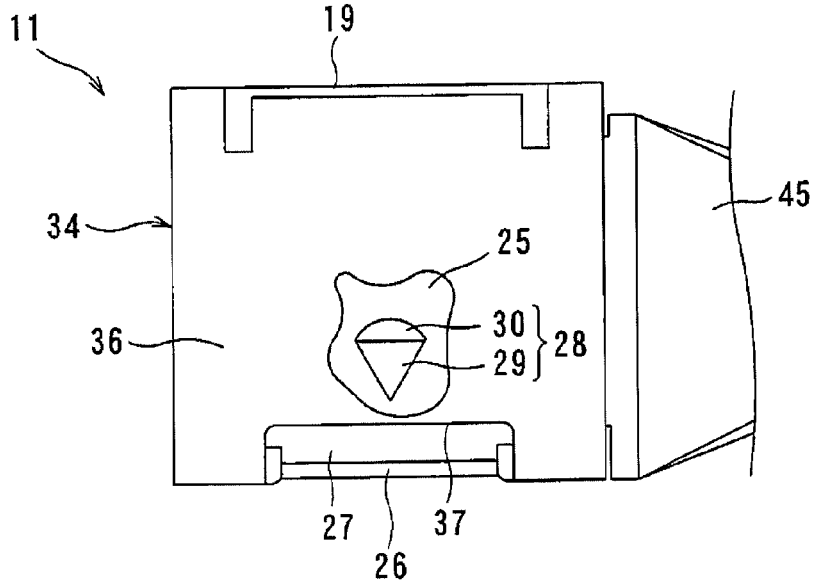
FIG. 4 is a partially broken plan view of a connector according to one or more embodiments of the present invention.

The abutment portion 25 extends from the front side end of the plate-shaped portion 21 through a step 23 toward the front side and in parallel with the base 12. The abutment portion 25 is formed in rectangular plate shape having long sides in the direction orthogonal to the direction inserting the terminal 58. The space between the abutment portion 25 and the base 12 is formed to be smaller than the thickness of the terminal 58 (see FIG. 14). At the end of the abutment portion 25, an engagement projection 27 is formed to project diagonally upward. At the center of the abutment portion 25, a fall-off prevention projection 28 is formed. The fall-off prevention projection 28 projects in the inward direction (to the base 12), and prevents the terminal 58 held between the base 12 and the abutment portion 25 from falling off. As shown in FIG. 4, the fall-off prevention projection 28 has a water droplet shape including a triangular projection 29 located on the opening 26 side and having a triangular shape in plan view so that the width thereof is increased from the opening 26 toward the bend portion 19, and a semi-circular projection 30 located on the bend portion 19 side, having a semi-circular shape in plan view, and integrally molded with the triangular projection 29.

Figure 2:
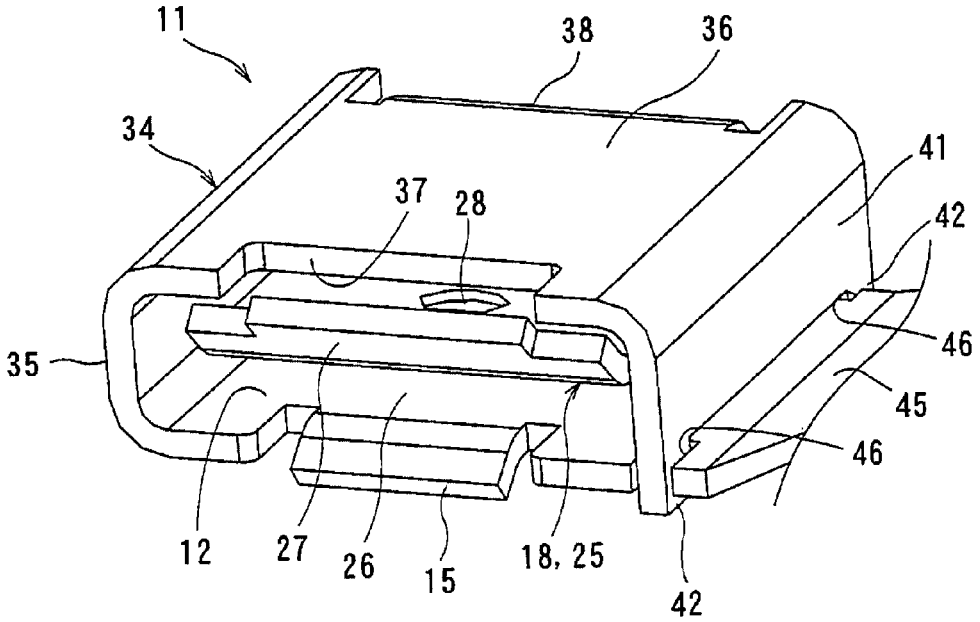
FIG. 2 is an enlarged perspective view of a connector according to one or more embodiments of the present invention.
Figure 3:
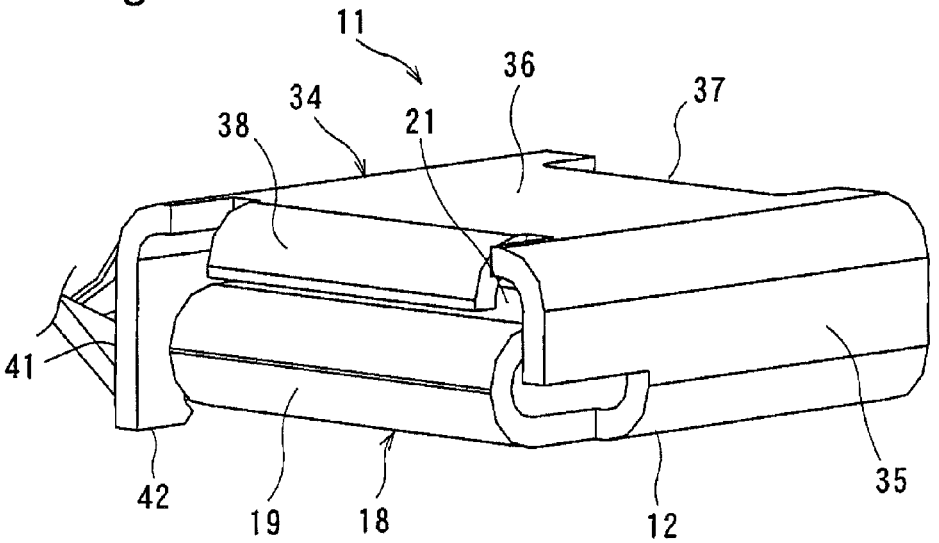
FIG. 3 is an enlarged perspective view of a connector according to one or more embodiments of the present invention.

As shown in FIGS. 2 and 3, the cover 34 is bent in the direction orthogonal to the direction from the opening 26 of the spring 18 toward the bend portion 19, and covers the spring 18. The cover 34 has a first side wall 35, a top wall 36, and a second side wall 41. The first side wall 35 is bent vertically upward from the base 12. The first side wall 35 has a rectangular plate shape having long sides in the extending direction of the spring 18. The first side wall 35 is disposed with predetermined spacing from the side edge of the spring 18, and covers the side edge of the spring 18.

The top wall 36 is horizontally bent from the upper end of the first side wall 35 toward the pressingly holding portion 45. The top wall 36 has a substantially square plate shape. The dimension of the top wall 36 in the direction orthogonal to the extending direction of the spring 18 (hereinafter, called a width dimension) is larger than the width dimension of the spring 18. The top wall 36 is fixed to the base 12 by the first side wall 35 and the second side wall 41 described below, and is disposed above and in parallel with the abutment portion 25 and the plate-shaped portion 21 (see FIG. 14). In addition, the top wall 36 covers the abutment portion 25 with predetermined spacing from the outer face of the abutment portion 25. At the front side end of the top wall 36, an engagement recess (engagement portion) 37 is formed to be recessed toward the back side. The width dimension of the engagement recess 37 is formed to be larger than the width dimension of the engagement projection 27. The engagement recess 37 is engaged with the engagement projection 27 of the abutment portion 25 shifted upward when the terminal 58 is pulled from the connector 10 (see FIG. 17). At the back side end of the top wall 36, a second tongue 38 is provided to be curved diagonally downward.

The second side wall 41 is bent vertically downward from the end of the top wall 36 on the pressingly holding portion 45 side. The second side wall 41 has a rectangular plate shape having long sides in the extending direction of the spring 18. The second side wall 41 is disposed with predetermined spacing from the side edge of the spring 18, and covers the side edge of the spring 18. On the second side wall 41, engagement pieces 42 are formed. The engagement pieces 42 project downward from both sides of the lower end of the second side wall 41. The engagement pieces 42 are engaged into the cutaway portions 46, so that the cover 34 in bent state is fixed to the base 12.

As shown in FIG. 1, the housing 51 includes a connector accommodating portion 53, a pressingly holding portion-accommodating portion 54, and a lid 55 opening and closing the connector accommodating portion 53 and the pressingly holding portion-accommodating portion 54. The connector accommodating portion 53 accommodates the connector body 11 therein. The pressingly holding portion-accommodating portion 54 accommodates the pressingly holding portion 45 therein. After the connector body 11 is accommodated in the connector accommodating portion 53 and the pressingly holding portion 45 is accommodated in the pressingly holding portion-accommodating portion 54, the lid 55 closes the opening for the connector accommodating portion 53 and the pressingly holding portion-accommodating portion 54. Inside an upper side forming the insertion hole 52, a pressing projection 56 is formed to project toward the connector 10 (see FIG. 14).

Figure 7:
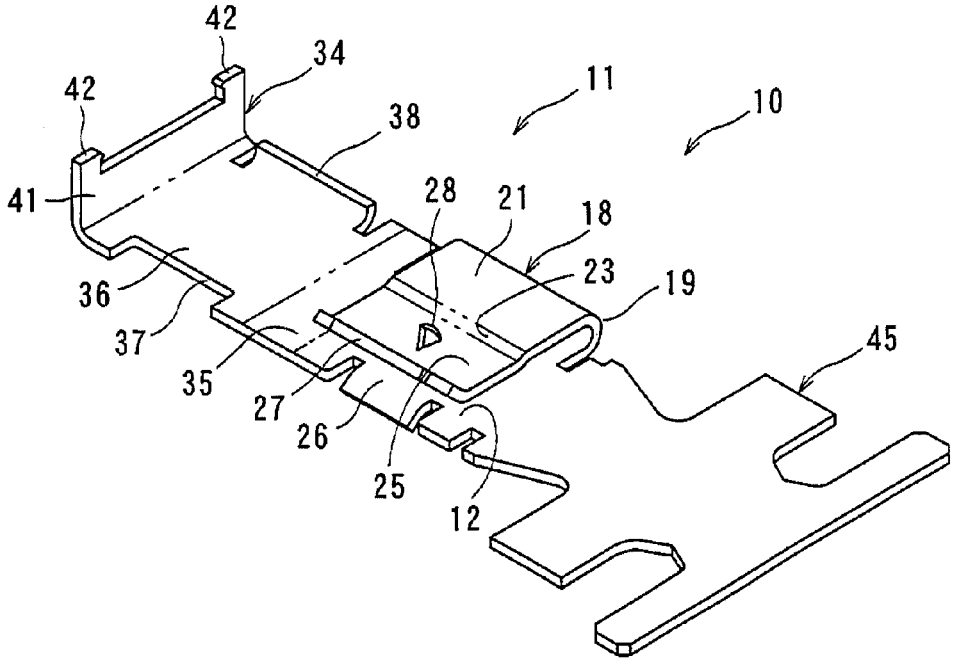
FIG. 7 is a perspective view showing a procedure of assembling a connector according to one or more embodiments of the present invention.
Figure 8:
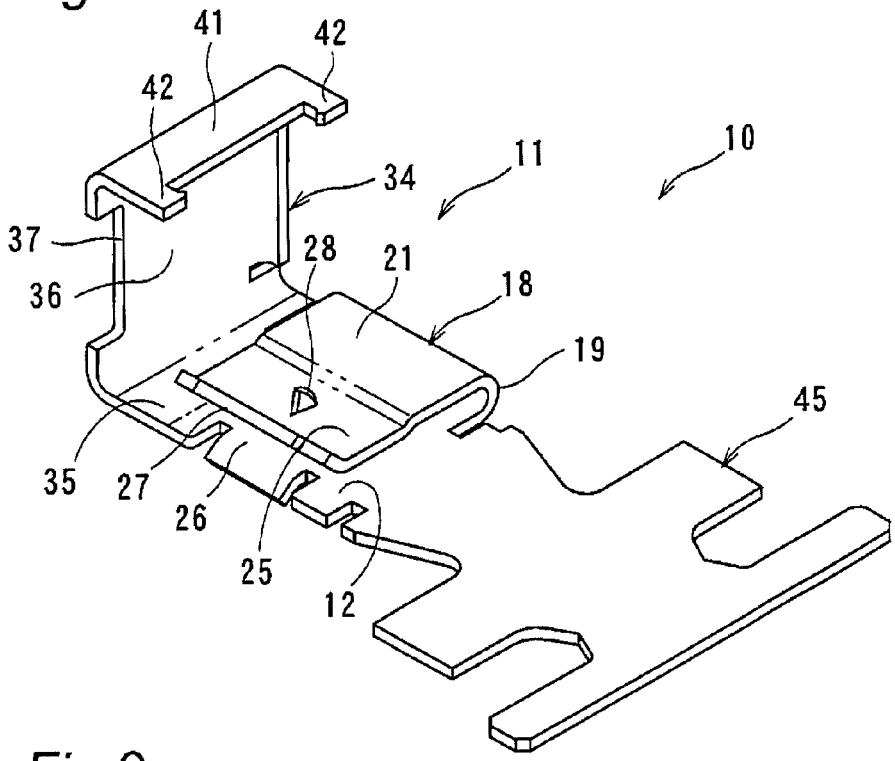
FIG. 8 is a perspective view showing a procedure of assembling a connector according to one or more embodiments of the present invention.
Figure 9:
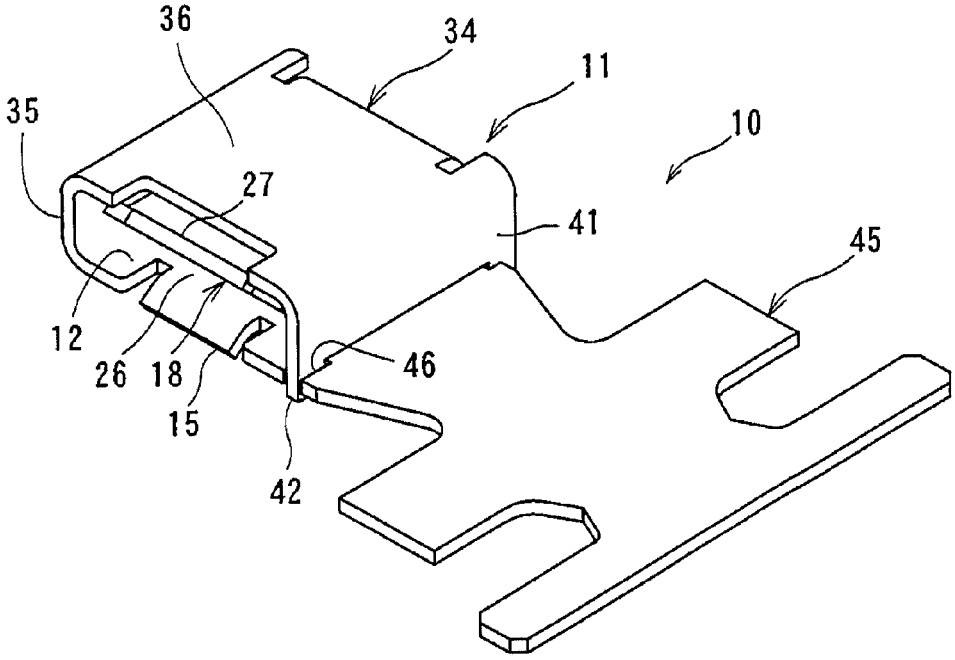
FIG. 9 is a perspective view of a connector body according to one or more embodiments of the present invention.

To assemble the connector 10 described above, the bend portion 19 is bent in U-shape with respect to the developed base 12 shown in FIG. 5. Thereby, as shown in FIG. 6, the plate-shaped portion 21 and the abutment portion 25 extend in parallel with the base 12 from the back side toward the front side, so that the opening 26 is formed between the end of the abutment portion 25 and the base 12. In addition, the engagement projection 27 is bent diagonally upward with respect to the abutment portion 25, and the first tongue 15 is bent to be curved diagonally downward with respect to the base 12. As shown in FIG. 7, the second side wall 41 of the cover 34 and the second tongue 38 are bent and erected. As shown in FIG. 8, the top wall 36 is erected. When the first side wall 35 is then bent and erected, as shown in FIG. 9, the cover 34 surrounds the spring 18 in the direction orthogonal to the direction from the opening 26 of the spring 18 toward the bend portion 19. Finally, the engagement pieces 42 of the second side wall 41 are engaged into the cutaway portions 46, thereby fixing the cover 34 to the base 12. As described above, the connector has a double configuration in which the cover 34 covers the spring 18 in the direction orthogonal to the extending direction of the spring 18. Therefore, other members can be prevented from interfering with the spring 18 from outside, so that the spring 18 can be protected.

Figure 10:
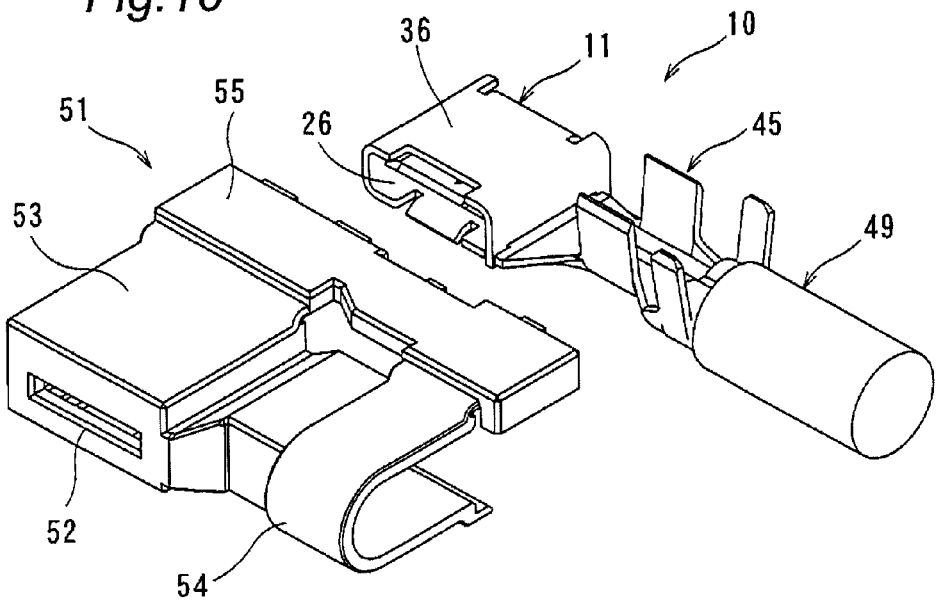
FIG. 10 is a perspective view showing a procedure of connecting a cable to a connector and accommodating the connector in a housing according to one or more embodiments of the present invention.
Figure 11:
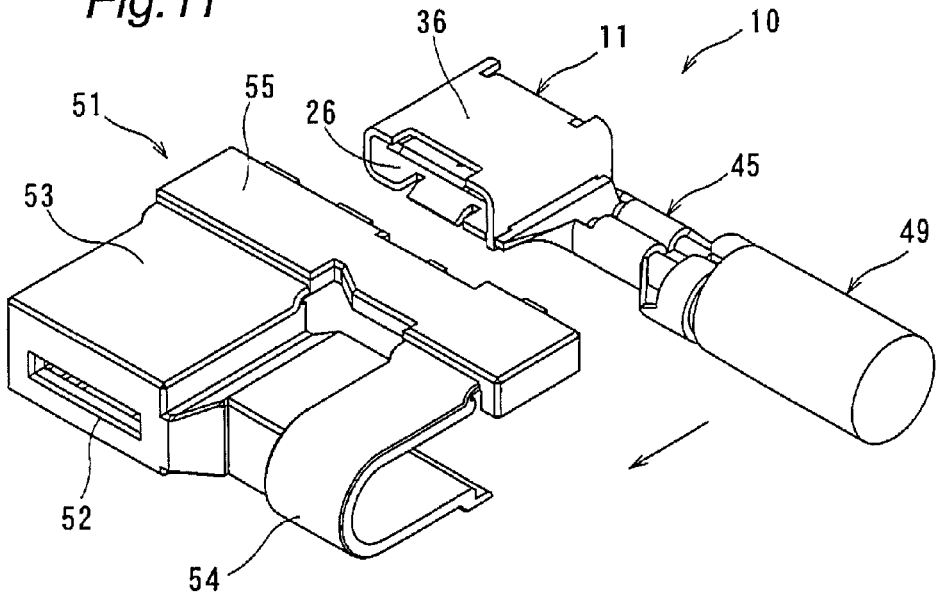
FIG. 11 is a perspective view showing a procedure of connecting a cable to a connector and accommodating the connector in a housing according to one or more embodiments of the present invention.
Figure 12:
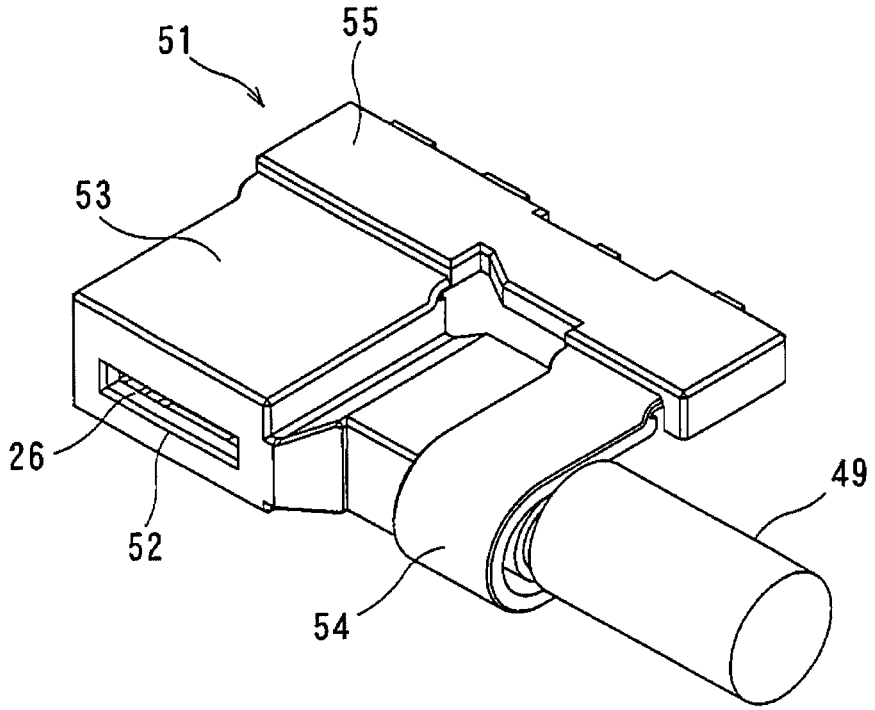
FIG. 12 is a perspective view showing a procedure of connecting a cable to a connector and accommodating the connector in a housing according to one or more embodiments of the present invention.
Figure 13:
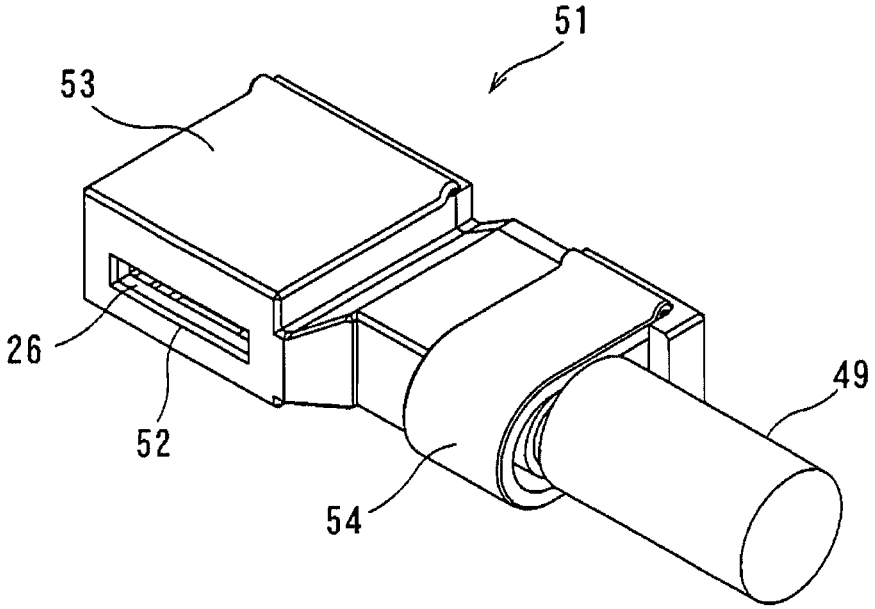
FIG. 13 is a perspective view showing a state of connecting a cable to a connector and accommodating the connector in the housing according to one or more embodiments of the present invention.

To use the assembled connector 10, as shown in FIG. 10, both outer sides of the pressingly holding portion 45 are bent upward, and the end of the cable 49 is positioned therein. As shown in FIG. 11, the outer ends of the pressingly holding portion 45 are bent in the inward direction and caulked with a tool, so that the pressingly holding portion 45 pressingly holds the cable 49. As shown in FIG. 12, the connector 10 and the cable 49 are then accommodated in the housing 51. As shown in FIG. 13, the lid 55 is closed to fix the connector 10 in the housing 51. At this time, the opening 26 of the spring 18 is matched with the insertion hole 52 of the housing 51.

Figure 14:
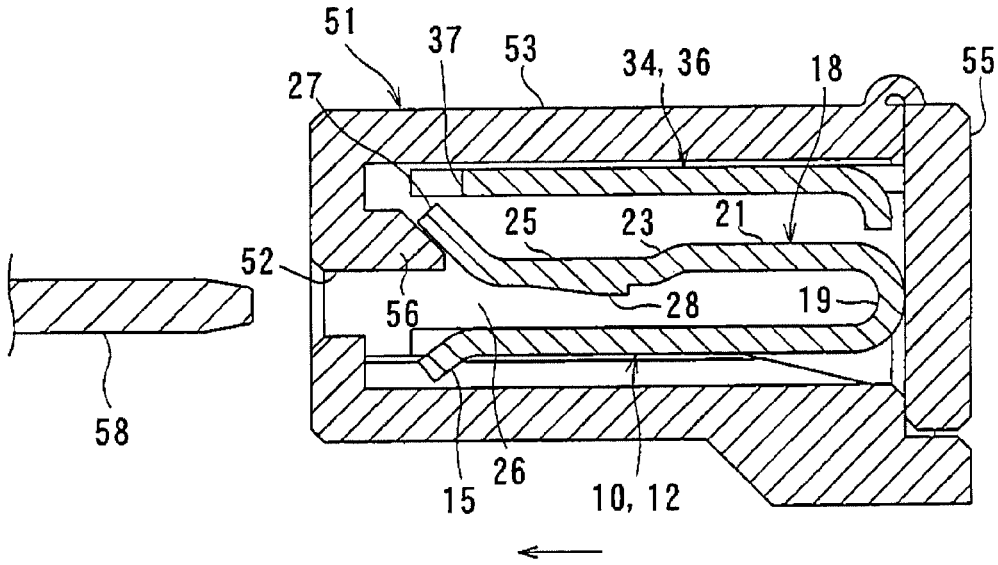
FIG. 14 is a cross-sectional view showing each stage of inserting a terminal into a connector according to one or more embodiments of the present invention.
Figure 15:
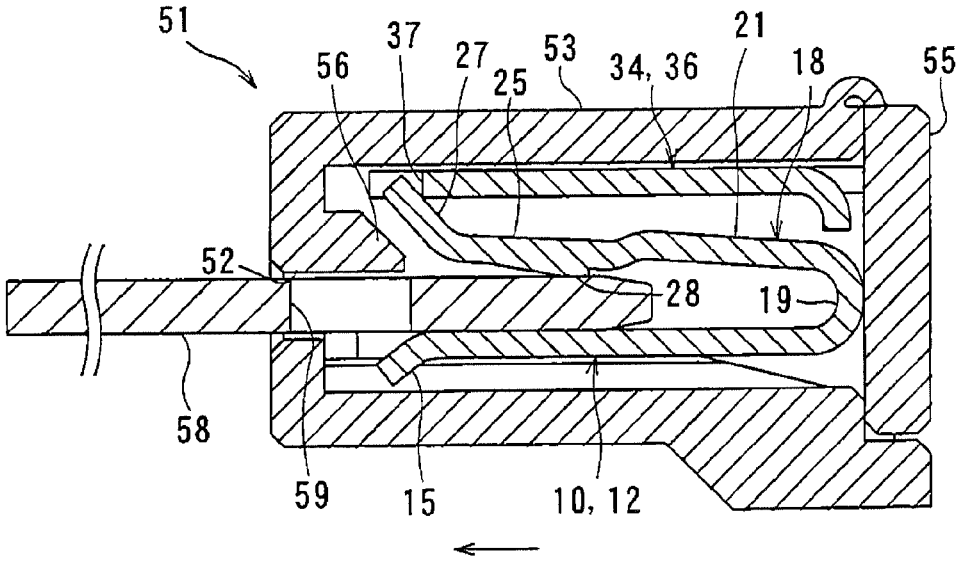
FIG. 15 is a cross-sectional view showing each stage of inserting a terminal into a connector according to one or more embodiments of the present invention.

FIGS. 14 and 15 show steps of conducting the cable 49 with the terminal 58. First, to insert the terminal 58 through the insertion hole 52 into the housing 51, the housing 51 is moved toward the terminal 58. Thereby, the terminal 58 is guided from the opening 26 of the connector 10 to between the spring 18 and the base 12. At this time, the abutment portion 25 is pushed up by the terminal 58, and is shifted upward against the resilient force of the spring 18.

Figure 16:
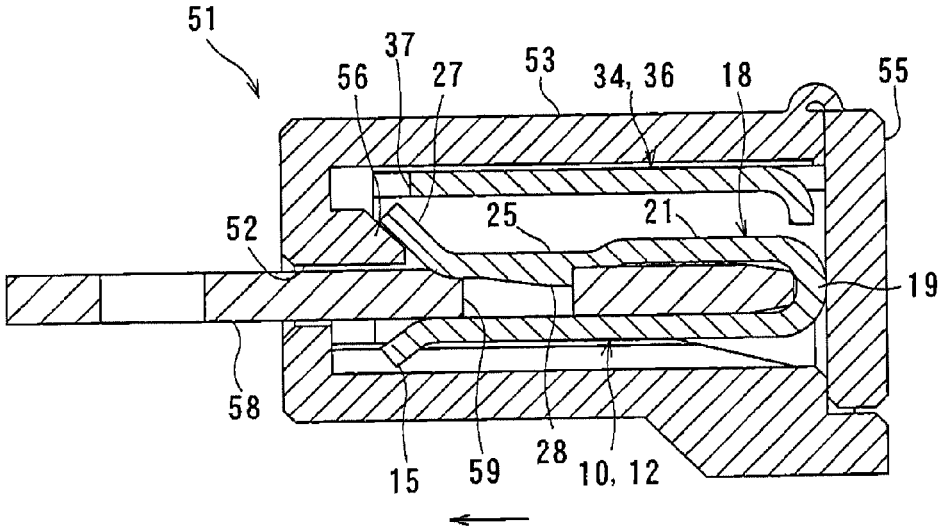
FIG. 16 is a cross-sectional view showing each stage of inserting a terminal into a connector according to one or more embodiments of the present invention.

When the insertion by pressing is continued, as shown in FIG. 16, the fall-off prevention projection 28 is engaged into the through hole 59. In this state, by the spring force of the spring 18, the terminal 58 is sandwiched between the base 12 and the abutment portion 25, and is prevented from falling off the connector 10. The spring 18 includes the bend portion 19 and the abutment portion 25, so that the length of the spring 18 can be adjusted to adjust the force for sandwiching the terminal 58 between the spring 18 and the base 12. Thereby, the terminal 58 can be easily inserted between the spring 18 and the base 12. In addition, the fall-off prevention projection 28 is engaged into the through hole 59, so that the terminal 58 sandwiched between the base 12 and the abutment portion 25 can be reliably prevented from falling off. The fall-off prevention projection 28 is formed in water droplet shape, so that the terminal 58 can be easily inserted between the base 12 and the abutment portion 25, and the terminal 58 can be hard to fall off once the terminal 58 is inserted between the base 12 and the abutment portion 25.

Figure 17:
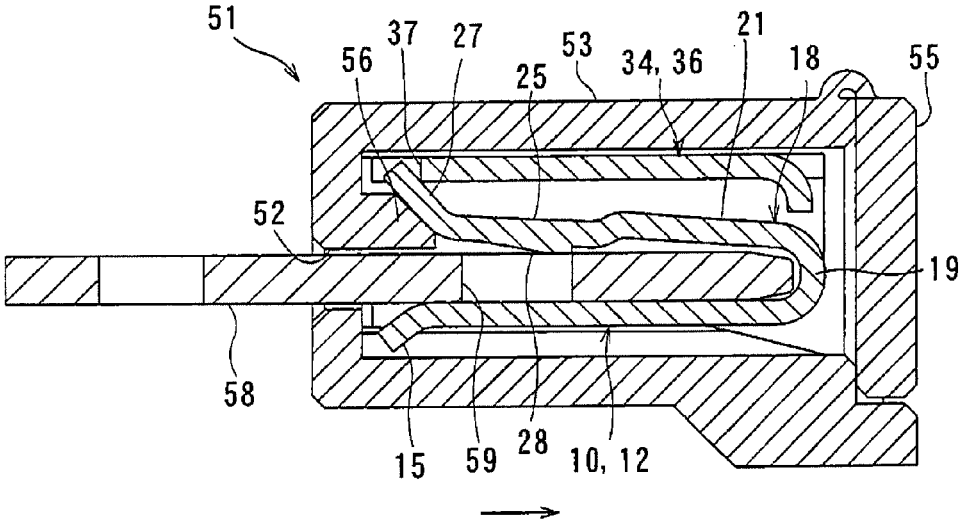
FIG. 17 is a cross-sectional view showing each stage of inserting a terminal into a connector according to one or more embodiments of the present invention.
Figure 18:
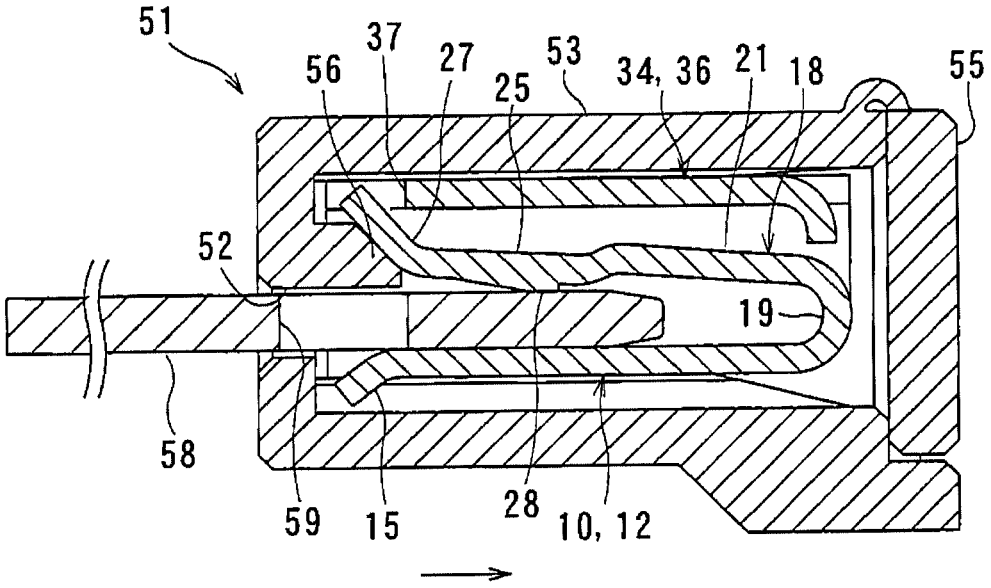
FIG. 18 is a cross-sectional view showing each stage of inserting a terminal into a connector according to one or more embodiments of the present invention.

When the housing 51 is held and moved in the direction pulling the connector 10 from the terminal 58, as shown in FIG. 17, the engagement projection 27 is moved over the pressing projection 56 of the housing 51. Thereby, the spring 18 is pushed up until the engagement projection 27 is engaged into the engagement recess 37. Thereby, by adjusting the space between the engagement projection 27 and the engagement recess 37, the amount in which the spring 18 is shifted upward can be adjusted. Therefore, the shift amount of the spring 18 can be regulated to prevent the spring 18 from being damaged. The spring 18 is shifted upward, so that the end of the spring 18 can be pushingly expanded to easily pull the connector 10 from the terminal 58. The fall-off prevention projection 28 of the abutment portion 25 is disengaged from the through hole 59 of the terminal 58. As shown in FIG. 18, the connector 10 is pulled from the terminal 58.

In the connected state of the connector 10 and the terminal 58, the fall-off prevention projection 28 is engaged into the through hole 59. If for instance, only the cable 49 other than the housing 51 is held and the connector 10 is pulled from the terminal 58, the pressing projection 56 of the housing 51 cannot push up the engagement projection 27. Thus, the terminal 58 cannot be pulled from the connector 10.

Second Example

Figure 19:
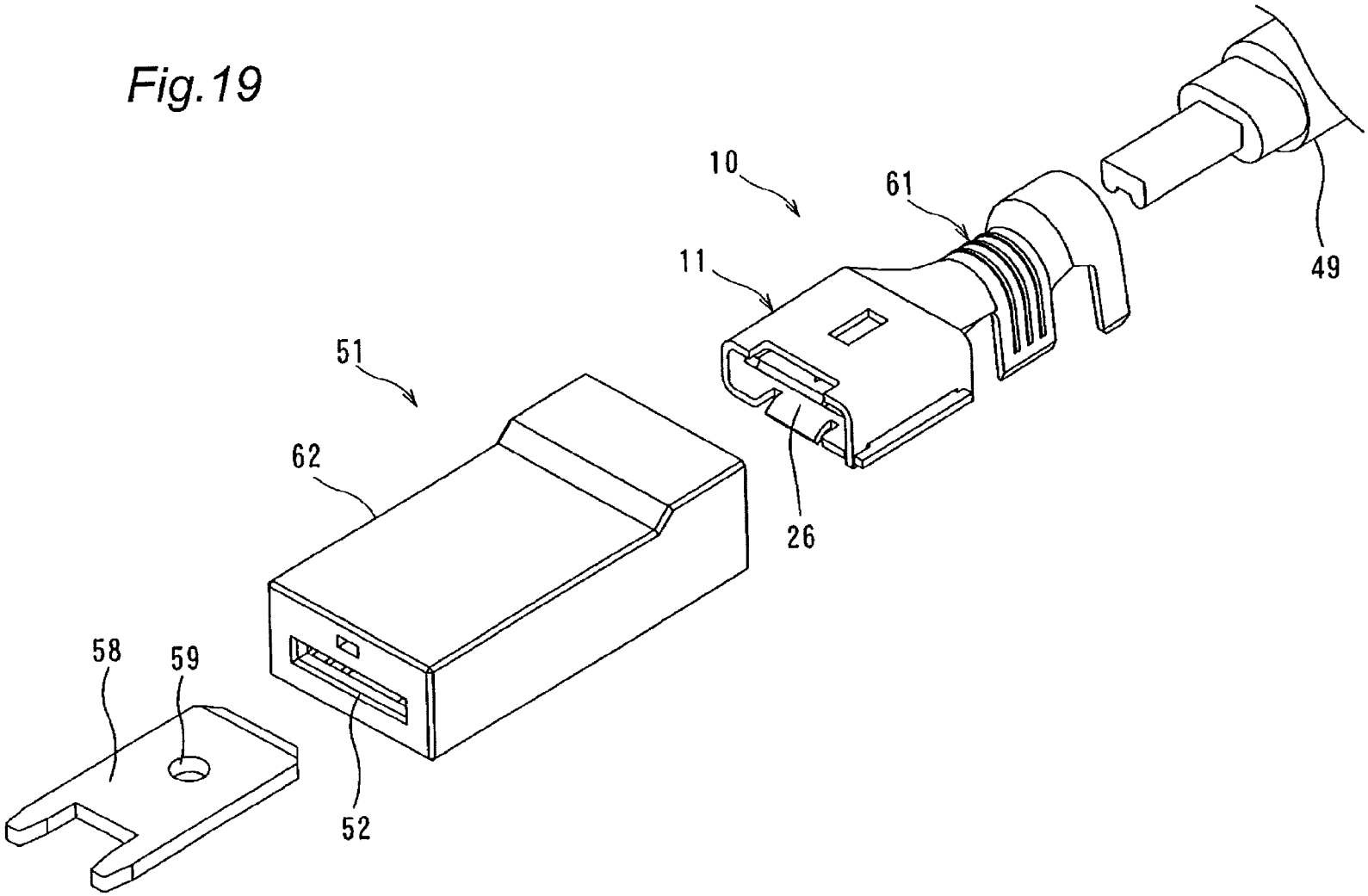
FIG. 19 is an exploded perspective view of a connection terminal using a connector according to one or more embodiments of the present invention.
Figure 20:
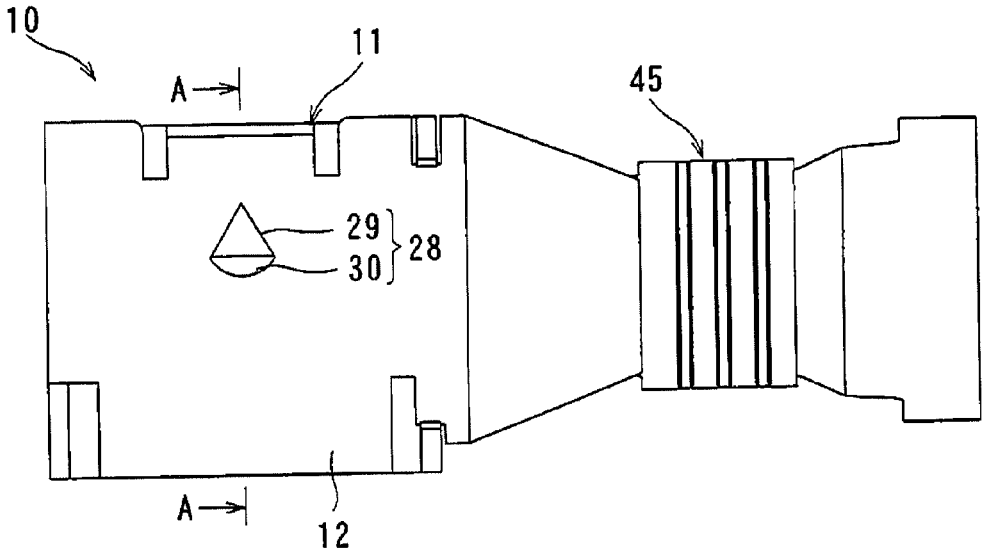
FIG. 20 is a bottom view of a connector according to one or more embodiments of the present invention.
Figure 21:
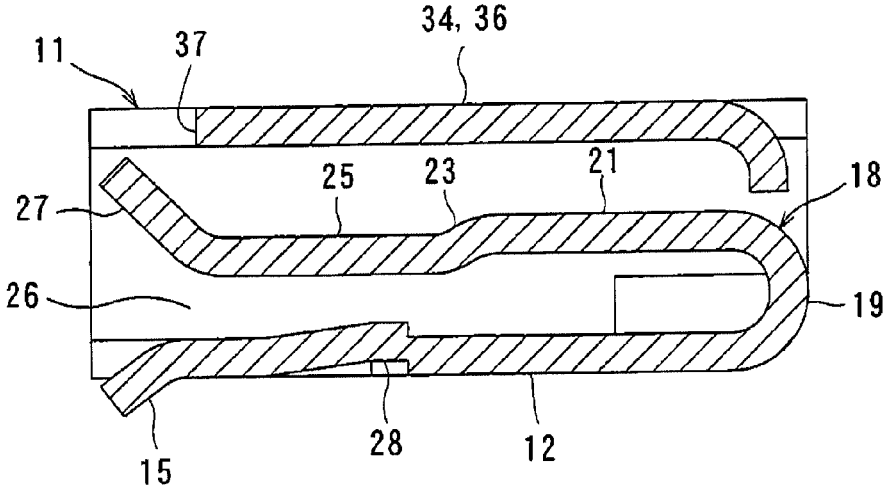
FIG. 21 is a cross-sectional view taken along line A-A of FIG. 20.

FIGS. 19 to 21 show the connector 10 of a second example. In the first example, the pressingly holding portion 45 is provided so that the direction from the opening 26 of the connector body 11 toward the bend portion 19 is orthogonal to the axial direction of the held cable 49. The second example is different from the first example in that a pressingly holding portion 61 is provided so that the direction from the opening 26 toward the bend portion 19 is matched with the axial direction of the held cable 49.

In addition, in the first example, the housing 51 includes the connector accommodating portion 53, and the pressingly holding portion-accommodating portion 54. The second example is different from the first example in that the housing 51 includes only a connector accommodating portion 62 which inserts and accommodates the connector 10 in the direction matched with the axial direction of the cable 49. Thereby, the connector 10 can be designed depending on the application thereof so as to obtain a general-purpose connector. The same elements as the first embodiment of FIG. 1 are indicated by similar reference numerals, and the description is omitted.

The present invention is not limited to the examples described above, and various modifications can be made.

For instance, in the aforementioned examples, the base 12 is formed in square shape, but may be formed in polygonal shape, such as triangular or pentagonal shape.

In the examples, the cover 34 surrounds the spring 18, but the connector body 11 may include only the spring 18 without providing the cover 34. Thereby, the configuration of the connector 10 can be simplified to reduce the manufacturing cost.

Figure 22:
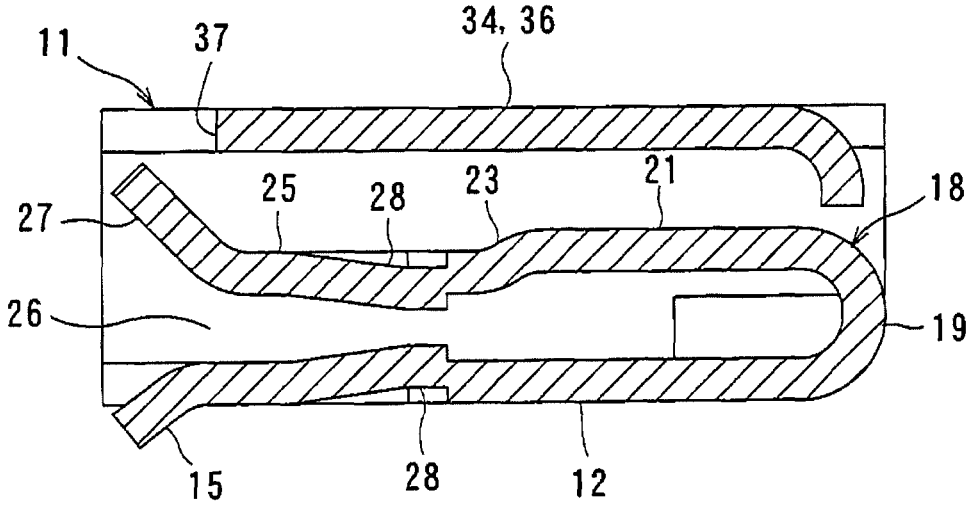
FIG. 22 is a cross-sectional view of a connector according to one or more embodiments of the present invention.

Further, in the examples, the fall-off prevention projection 28 is provided on the abutment portion 25, but as shown in FIGS. 20 and 21, may be provided on the base 12, and as shown in FIG. 22, may be provided on both the abutment portion 25 and the base 12.

In the examples, the through hole 59 of the terminal 58 is formed in circular shape, but may be formed in polygonal shape, such as square shape.

Figure 23:
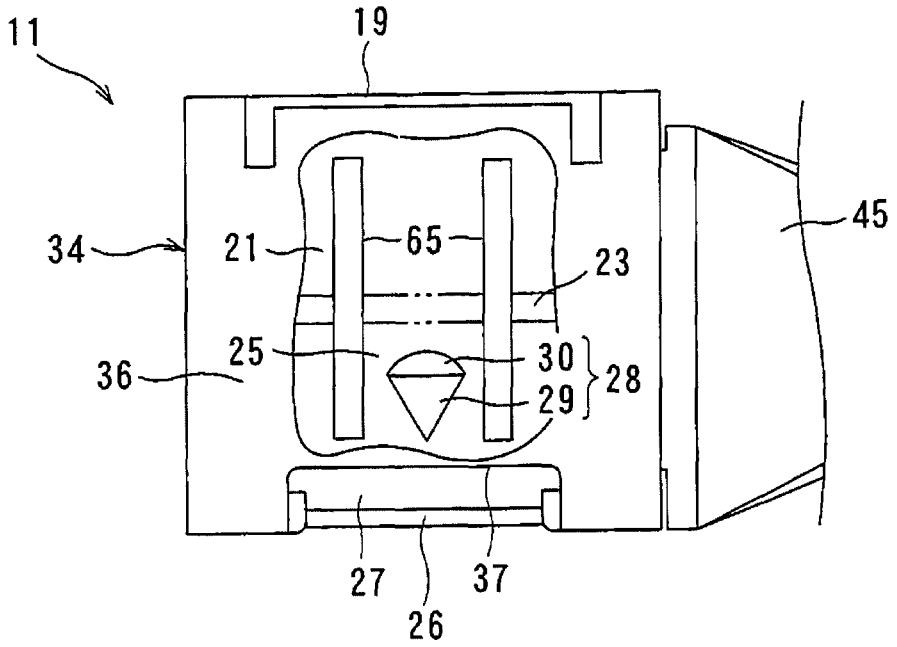
FIG. 23 is a partially broken plan view of a connector showing a modification in which the fall-off prevention projection and slits are provided in the abutment portion according to one or more embodiments of the present invention.

In the configuration in which the fall-off prevention projection 28 is provided on the abutment portion 25, as shown in FIG. 23, linear slits 65 may be formed from the abutment portion 25 through the step 23 to the plate-shaped portion 21. By providing the slits 65, the spring force of the spring 18 can be adjusted. The shape and disposed position of the slits 65 are not particularly limited.

In the examples, the connector 10 is accommodated in the housing 51, but only the connector 10 may be used without using the housing 51. At this time, when the terminal 58 is pulled from the connector 10, the user pushes up the engagement projection 27 of the spring 18 by the fingers so that the fall-off prevention projection 28 can be disengaged from the through hole 59.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a base;

a spring having a bend portion bent from an edge of the base and an abutment portion continued from the bend portion, the spring extends along the base and is sandwiched between the base and the abutment portion; and a terminal inserted toward the bend portion from an opening located on an opposite side of the bend portion and formed between the base and the abutment portion, a cover extending from the base and covering the abutment portion with a predetermined spacing from an outer face of the abutment portion, the cover having a top wall provided with an engagement portion that is position regulated by being engaged with an end of the abutment portion and pushingly expanded when the terminal is inserted into and removed from the opening.

2. The connector according to claim 1, wherein the spring extends from the edge of the base in a rectangular shape, and the cover extends from an other edge adjacent to the edge, and is bent in a direction cross to a direction from the opening of the spring toward the bend portion to cover the spring.

3. The connector according to claim 1, wherein at least one of the base and the abutment portion is provided with a fall-off prevention projection that projects in an inward direction and is engaged into a through hole of the terminal for fall-off prevention.

4. The connector according to claim 3, wherein the fall-off prevention projection has a water droplet shape including a triangular projection located on an opening side and having a triangular shape in a plan view so that a width thereof is increased from the opening toward the bend portion, and a semi-circular projection located on the bend portion side having a semi-circular shape in the plan view, and integrally molded with the triangular projection.

5. The connector according to claim 1, wherein at least one slit for a spring force adjustment is provided in the abutment portion.

6. The connector according to claim 1, further comprising a pressingly holding portion that pressingly holds a cable conducting with the terminal, wherein a direction from the opening toward the bend portion is orthogonal to an axial direction of the held cable.

7. The connector according to claim 1, further comprising a pressingly holding portion that pressingly holds a cable conducting with the terminal, wherein a direction from the opening toward the bend portion is parallel to an axial direction of the held cable.

8. The connector according to claim 1, further comprising a housing having an insertion hole communicating into the opening formed between the base and the abutment portion accommodated therein, and a pressing projection that projects in an inward direction from an edge of the insertion hole and can pushingly expand an end of the spring when the terminal is pulled.

* * * * *